US011258207B2

(12) United States Patent
Dück et al.

(10) Patent No.: US 11,258,207 B2
(45) Date of Patent: Feb. 22, 2022

(54) SHIELDED PLUG CONNECTOR MODULE FOR A MODULAR INDUSTRIAL PLUG CONNECTOR

(71) Applicant: HARTING Electric GmbH & Co. KG, Espelkamp (DE)

(72) Inventors: Jakob Dück, Espelkamp (DE); Christof Hermoni, Espelkamp (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 58 days.

(21) Appl. No.: 16/975,452

(22) PCT Filed: Apr. 12, 2019

(86) PCT No.: PCT/DE2019/100339

§ 371 (c)(1),
(2) Date: Aug. 25, 2020

(87) PCT Pub. No.: WO2019/201390

PCT Pub. Date: Oct. 24, 2019

(65) Prior Publication Data

US 2021/0021086 A1 Jan. 21, 2021

(30) Foreign Application Priority Data

Apr. 16, 2018 (DE) ..... 10 2018 108 968.6

(51) Int. Cl.
*H01R 13/648* (2006.01)
*H01R 13/6582* (2011.01)
(Continued)

(52) U.S. Cl.
CPC ..... *H01R 13/6582* (2013.01); *H01R 13/514* (2013.01); *H01R 13/6592* (2013.01)

(58) Field of Classification Search
CPC ..... H01R 13/6581; H01R 13/6582; H01R 13/6591; H01R 13/6592; H01R 13/46; H01R 13/514
(Continued)

(56) References Cited

U.S. PATENT DOCUMENTS 5,500,788 A 3/1996 Longueville et al.
5,511,992 A 4/1996 Thalhammer
(Continued)

FOREIGN PATENT DOCUMENTS

DE 29815378 U1 12/1999
DE 10232186 C1 9/2003
(Continued)

*Primary Examiner* — Khiem M Nguyen
(74) *Attorney, Agent, or Firm* — Smartpat PLC

(57) ABSTRACT

The invention relates to a system consisting of a first plug connector module (2) and a second plug connector module (3), each of which is to be used in a modular industrial plug connector. The first plug connector module (2) has a first shield transfer element (5), and the second plug connector module (3) has a second shield transfer element (6). A cable connected to the plug connector module (2, 3) can be secured on a connection side (A) of each shield transfer element (5, 6), and the shield transfer elements (5, 6) can be brought into electric contact with each other on the plug side.

15 Claims, 6 Drawing Sheets

(51) Int. Cl.
*H01R 13/514* (2006.01)
*H01R 13/6592* (2011.01)

(58) Field of Classification Search
USPC ..... 439/607.23
See application file for complete search history.

(56) References Cited

U.S. PATENT DOCUMENTS

| | | | |
|---|---|---|---|
| 5,934,939 | A | 8/1999 | Thenaisie et al. |
| 2005/0112920 | A1 | 5/2005 | Venaleck et al. |
| 2017/0229807 | A1 | 8/2017 | Nass et al. |
| 2017/0250490 | A1 | 8/2017 | Beischer et al. |
| 2018/0254578 | A1 | 9/2018 | Herbrechtsmeier et al. |
| 2019/0312391 | A1 | 10/2019 | Meier et al. |
| 2020/0059034 | A1 | 2/2020 | Tiemann et al. |
| 2021/0021086 | A1* | 1/2021 | Duck ..... H01R 13/6592 |

FOREIGN PATENT DOCUMENTS

| | | | |
|---|---|---|---|
| DE | 69722303 | | 2/2004 |
| DE | 202006016545 | U1 | 4/2007 |
| DE | 202006012687 | U1 | 12/2007 |
| DE | 202008004428 | U1 | 8/2009 |
| DE | 102014110279 | | 6/2015 |
| DE | 102014113481 | A1 | 3/2016 |
| DE | 102015114703 | A1 | 3/2017 |
| FR | 2952761 | B1 | 5/2012 |

* cited by examiner

SHIELDED PLUG CONNECTOR MODULE FOR A MODULAR INDUSTRIAL PLUG CONNECTOR

TECHNICAL FIELD

The disclosure is based on a system consisting of a first plug connector module and a second plug connector module, each for use in a modular industrial plug connector.

BACKGROUND

Plug connector modules are required as constituent parts of a plug connector modular system in order to be able to flexibly adapt a plug connector, in particular a heavy-duty industrial plug connector, to meet specific requirements in respect of signal and energy transmission, for example between two electrical devices. To this end, plug connector modules are usually inserted into corresponding holding frames which are sometimes also referred to as articulated frames, module frames or modular frames. Therefore, the holding frames serve to receive a plurality of plug connector modules which are identical to one another and/or different from one another and to safely secure said plug connector modules to a surface and/or a device wall and/or in a plug connector housing or the like.

The plug connector modules typically each have a substantially cuboidal insulating body or a cuboidal housing. These insulating bodies or housings can serve, for example, as contact carriers and accommodate and fix a wide variety of contacts. Therefore, the function of a plug connector formed in this way is very flexible. Pneumatic modules, optical modules, modules for transmitting electrical energy and/or electrical analog and/or digital signals, for example, can be accommodated in the respective insulating body or housing and therefore used in plug connector modular systems. Plug connector modules are increasingly also taking on measurement- and data-related tasks.

For example, holding frames which are formed from two frame halves which are connected to one another in an articulated manner can be used. The plug connector modules are provided with approximately rectangular holder means which project on the narrow sides. Recesses which are designed as openings which are closed on all sides and which the holder means enter when the plug connector modules are inserted into the holding frame are provided in the side parts of the frame halves. The holding frame is folded open, that is to say opened, for inserting the plug connector modules, wherein the frame halves are folded open about the joints only to such an extent that the plug connector modules can be inserted. The frame halves are then folded together, that is to say the holding frame is closed, wherein the holder means enter the recesses and the plug connector modules are securely held in an interlocking manner in the holding frame.

DE 10 2014 110 279 B3 discloses a plug connector module with a centrally arranged contact element. The contact element is designed for transmitting high currents. However, if, for example, further plug connector modules for transmitting high-frequency signals are provided in addition to plug connector modules of said kind, they can unfortunately have a negative influence on the data signals.

Metal plug connector housings, as are disclosed in DE 10 2014 113 481 A1 for example, are usually already used for heavy-duty plug connectors for safety reasons. Plug connector housings of this kind are produced, for example, using a zinc die-casting process or using an aluminum die-casting process. As a result, a certain degree of electrical and/or magnetic shielding is automatically provided. One disadvantage with this design is the very complicated production. Accordingly, said plug connector housings are generally too expensive to be used exclusively for shielding purposes.

The German Patent and Trademark Office has performed a search of the following prior art in the priority application pertaining to the present application: DE 102 32 186 C1, DE 20 2006 012 687 U1, DE 20 2006 016 545 U1, DE 20 2008 004 428 U1, DE 697 22 303 T2, U.S. Pat. Nos. 5,511,992 A, 5,500,788 A.

SUMMARY

The object of the disclosure is to propose a plug connector module for a reliable and at the same time cost-effective modular industrial plug connector.

The system according to the disclosure consists of a first plug connector module and a second plug connector module. The plug connector modules are intended especially for a modular industrial plug connector and in particular for being fixed in a modular holding frame.

The two plug connector modules each have a shield transfer element. The shield transfer elements consist of a metal material which has, in particular, good electrically conductive properties. The respective shield transfer element can be connected, on the cable connection side, to a cable and, in particular, to a shield braid of the connected cable. The first and the second shield transfer element are electrically contact-connected to one another on the plug side. This means the shield transfer elements are in physical contact with one another.

The characteristic impedance, also referred to as the characteristic wave impedance, can be considerably reduced by the shield transfer elements of the system.

In a particularly advantageous refinement, the first shield transfer element is of substantially flat configuration and is bent in a wave-shaped manner only on the plug side. In this case, the wave shape can correspond to a kind of round wave shape when viewed from the side or when viewed toward the narrow side. However, an angled variant is also conceivable as an alternative. The first shield transfer element advantageously has, on the plug side, at least one slot which runs in the plugging direction. The first shield transfer element particularly advantageously has, on the plug side, three slots which run in the plugging direction. The first shield transfer element can be produced from a flat sheet-metal material using a stamping and bending process in a simple and cost-effective manner.

The second shield transfer element is preferably of continuously flat design. Contact-making fingers, which catch onto the second, flat shield transfer element for the purpose of making electrical contact, are formed by the abovementioned slots on the plug side. Reliable contact-connection, which can be realized without a large expenditure of force during the plugging process, can be achieved by this refinement.

In a further particularly advantageous refinement, the first and the second shield transfer element are of T-shaped configuration on the cable connection side, wherein the T-bar is formed at the end side. The width of the first and of the second shield transfer element is preferably smaller on the cable connection side than on the plug side. This geometry is very suitable for being connected to a shield braid of a cable to be connected.

In a preferred refinement, the first and the second shield transfer element each have a cable fixing element on the cable connection side. The cable fixing element is preferably designed as a hose clip. In this way, the shield braid of the cable can be electrically conductively fixed to the respective shield transfer element. At the same time, strain relief for the connected cable can be realized by a hose clip.

In a preferred refinement, the first and the second shield transfer element each cover a side surface of the plug connector module at least in regions. This means that the substantially cuboidal housing of the plug connector module has a side surface which is covered by the shield transfer element at least in regions. Said side surface is a side surface which is oriented to an adjacent plug connector module in a holding frame. The shield transfer element can therefore have its desired shielding effect in the desired direction.

The first and the second shield transfer element preferably cover a large portion, preferably at least 75% and particularly preferably at least 90%, of the respective side surface of the plug connector module. These proportions of coverage have proven suitable in practice. This is particularly advantageous in order to achieve shielding which is appropriate for the respective application.

In a further preferred refinement, the first and the second plug connector module each have at least three contact elements by way of each of which a current with a current intensity of at least 16 Amperes can be transmitted. A current with a current intensity of more than 20 Amperes can preferably be transmitted. In order to be able to transmit currents of this kind, a contact element has to have a certain material thickness and a certain surface area (square millimeters). In general, said contacts are so-called turned contacts which are machined from solid material. More delicate contacts, as are used in signal and data plug connectors for example, cannot transmit current intensities of this kind.

In a preferred variant, the first and the second plug connector module each have a holding plate by way of which the contact elements can be secured in the plug connector module. The contact elements are inserted into recesses of a main body and are fixed in the main body by means of the holding plate. In this case, the contact elements still have a certain amount of play in order to make the process of plug-connecting the first plug connector module to the second plug connector module easier. The holding plate has fixing arms which project in a perpendicular manner, point in the plugging direction, engage around the individual contact elements, and in this way hold said contact elements in the insulating body or fix them therein.

BRIEF DESCRIPTION OF THE DRAWINGS

An exemplary embodiment of the invention is illustrated in the drawings and will be explained in more detail below.

DETAILED DESCRIPTION

The figures contain partially simplified, schematic illustrations. In some cases, identical reference signs are used for similar but not identical elements. Different views of the same elements can be shown to different scales.

Figure 1:
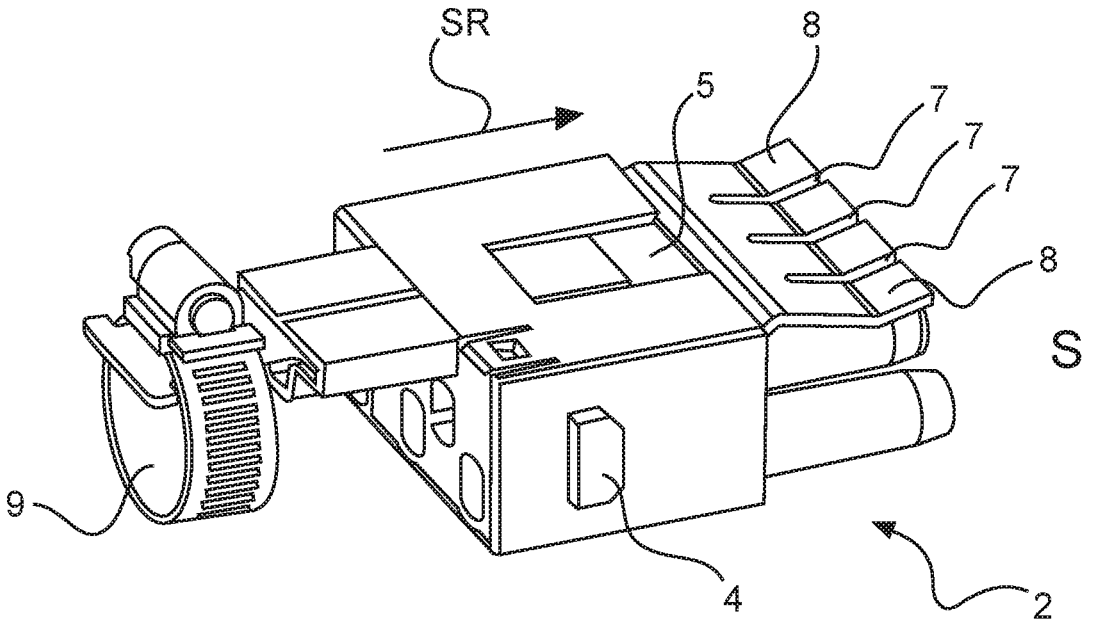
FIG. 1 shows a perspective illustration of a first plug connector module.
Figure 2:
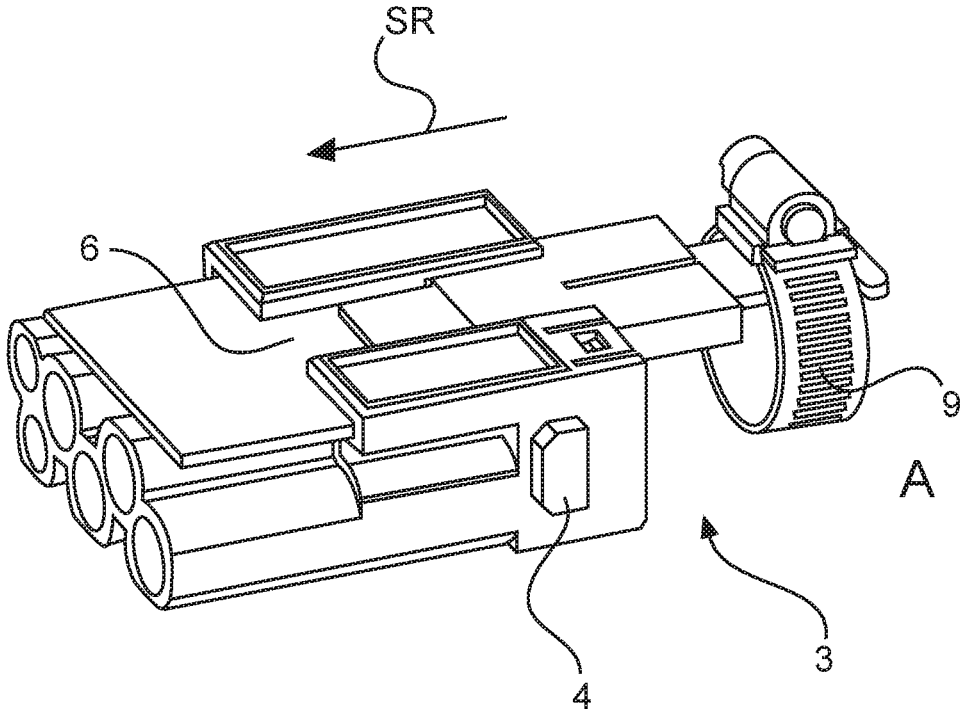
FIG. 2 shows a perspective illustration of a second plug connector module.

FIG. 1 shows a first plug connector module 2 and FIG. 2 shows a second plug connector module 3, which plug connector modules are each intended to be inserted into a holding frame, as shown in DE 10 2015 114 703 A1 for example, of a modular industrial plug connector (not shown). To this end, the plug connector modules 2, 3 are provided with approximately rectangular holder means 4 which project from the narrow sides. Recesses which are designed as openings which are closed on all sides and which the holder means 4 enter when the plug connector modules 2, 3 are inserted into the holding frame are provided in the side parts of the frame halves of the holding frame.

Figure 3:
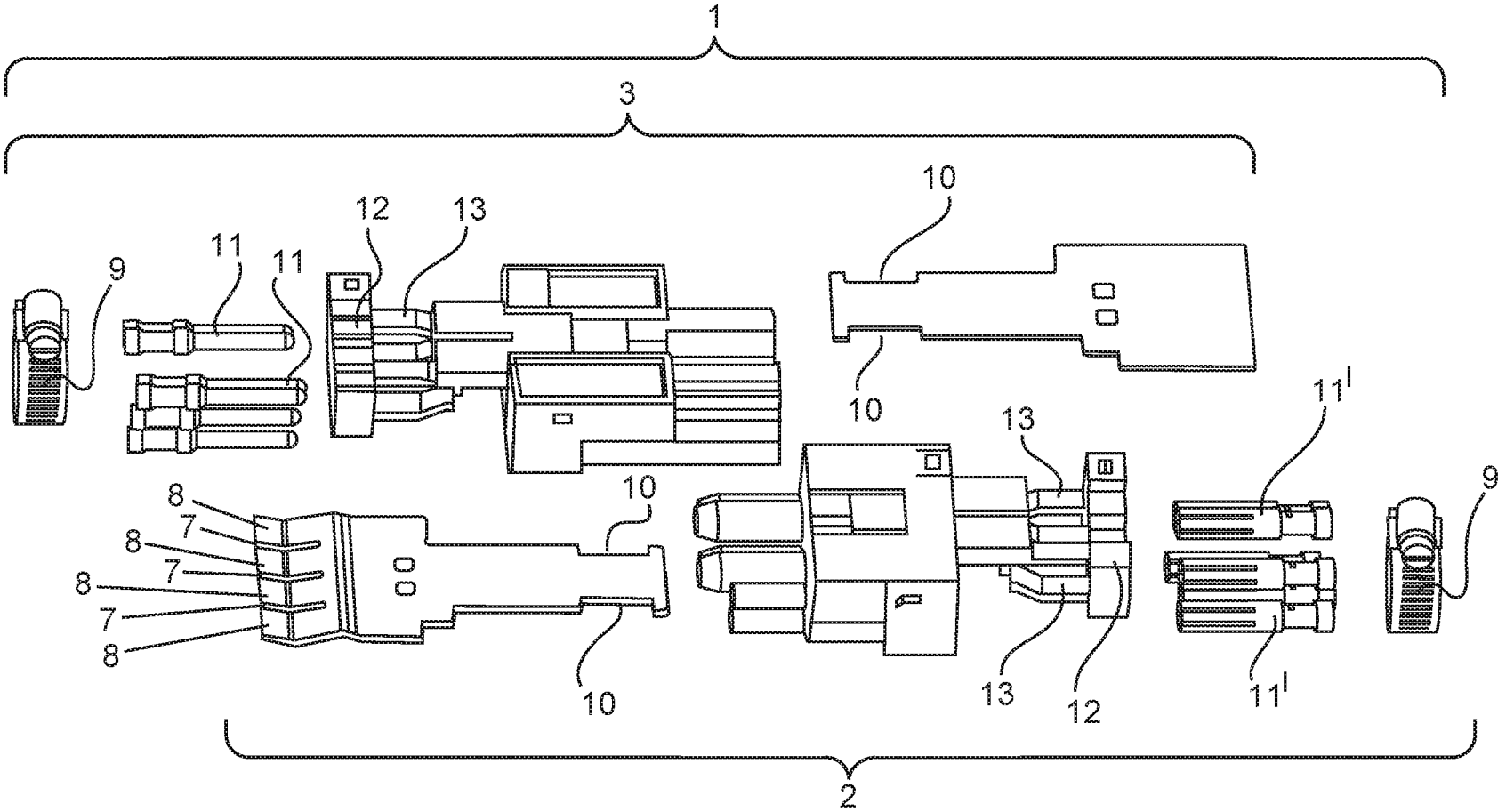
FIG. 3 shows a perspective exploded drawing of a system consisting of the first and the second plug connector module.
Figure 6:
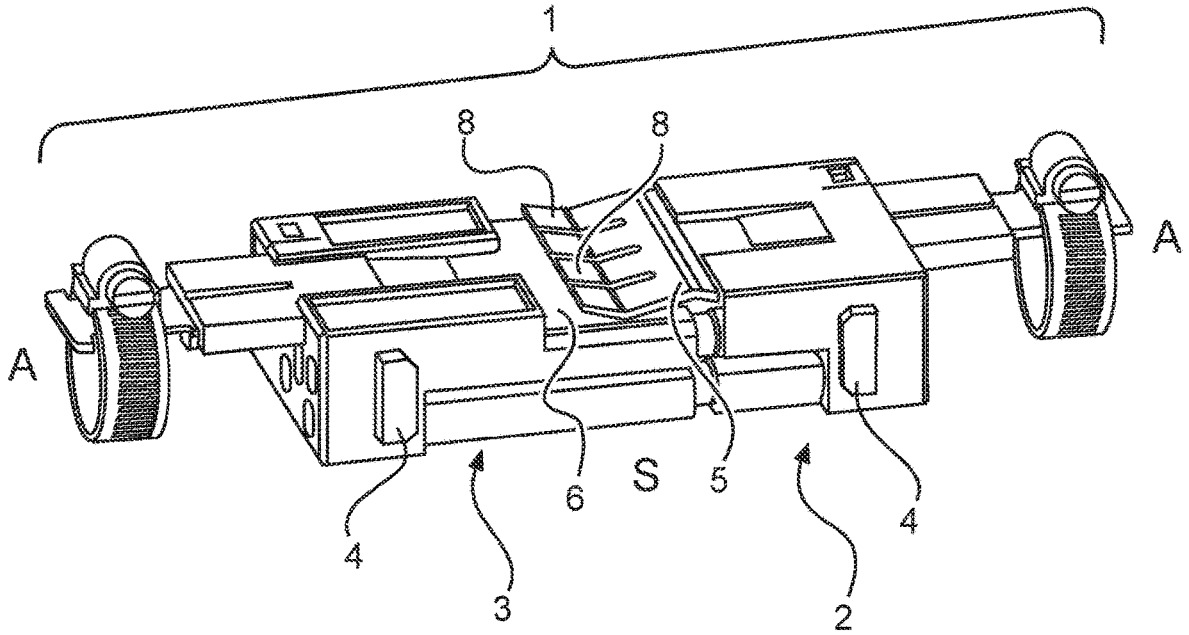
FIG. 6 shows a perspective illustration of the system consisting of the first and the second plug connector module.

The first plug connector module 2 and the second plug connector module 3 are each inserted into a modular industrial plug connector by means of a holding frame and are accordingly correspondingly arranged oppositely. In this context, the plug connector modules 2, 3 function as a system 1, as can be seen in FIGS. 3 and 6.

The plug connector modules 2, 3 have a plug side S and a connection side A. The plug side S is also described by "on the plug side" below. Analogously, the connection side A is also referred to as "on the connection side". A cable (not shown for reasons of illustration) is connected to the respective connection side A. The plug connector modules 2, 3 are combined and plugged together by way of the plug side S.

The first plug connector module 2 and the second plug connector module 3 are each brought together and plugged in the plugging direction SR, SR'. The first plug connector module 2 has a first shield transfer element 5 and the second plug connector module 3 has a second shield transfer element 6. The shield transfer elements 5, 6 are produced from a metal workpiece using a stamping and bending process. A shield braid of a cable can be connected to each of the shield transfer elements 5, 6 on the cable connection side. The shield braid of the cable is electrically conductively connected to the respective shield transfer element 5, 6. The shield transfer elements 5, 6 are electrically conductively connected to one another or contact-connected on the plug side S.

The second shield transfer element 6 is of completely flat design. The first shield transfer element 5 of the first plug connector module 2 is likewise of flat configuration for the most part. The only exception here is the plug side S end of the shield transfer element 5. The shield transfer element 5 is of wave-shaped or corrugated design on the plug side. This shape is achieved by the metal sheet being bent upward once and then bent downward once, or vice versa, over its course in this region. The first shield transfer element 5 has, on the plug side S,—substantially within the wave-shaped region—axial slots 7 which run in the plugging direction SR.

Contact-making fingers 8 are formed on the first shield transfer element 5 by the slots 7.

FIG. 6 shows a first plug connector module 2 and a second plug connector module 3 which are plug-connected to one another. A holding frame and a matching plug connector housing are not shown for reasons of illustration. In the plugged state, the shield transfer elements 5, 6 are electrically conductively connected to one another on the plug side. In the plugging process, the first shield transfer element 5 of the first plug connector module 2 slides over the second shield transfer element 6 of the second plug connector module 3. The contact-making fingers 8 of the first shield transfer element 5 engage or press onto the plug-side end of the second shield transfer element 6. The force with which the contact-making fingers 8 of the first shield transfer element 5 press onto the second shield transfer element 6 can be adjusted by the above-described wave-shaped bend and an appropriate selection of material.

The first and the second shield transfer element 5, 6 each have, on the connection side, two opposite, rectangular notches 10 which form a T-shaped end. The first and the second shield transfer element 5, 6 are each equipped with a hose clip 9 on the connection side A. The hose clip 9 is arranged in the region of the notches 10. The shield braid of a cable (not shown) which is connected to the respective plug connector module 2, 3 can be electrically conductively connected to the respective shield transfer element 5, 6 by way of the hose clip 9. At the same time, the hose clip 9 provides strain relief for the cable.

In each case six contact elements 11, 11' are arranged in the first and the second plug connector module 2, 3. The plug connector modules 2, 3 are suitable, in particular, as so-called motor plug connectors for an electric motor. At least three contact elements 11, 11' are configured in such a way that a current with a current intensity of at least 16 Amperes can be transmitted by means of said contact elements.

The first and the second plug connector module 2, 3 each have a holding plate 12 with fingers 13 which are integrally formed in the plugging direction. The contact elements 11, 11' are secured or fixed in the plug connector module 2, 3 by means of the holding plate 12 in addition to fingers 13. The contact elements 11, 11' are fixed in a captive manner, but still have a certain degree of play in their respective recess 14 in order to ensure a required tolerance during the plugging process.

Figure 4:
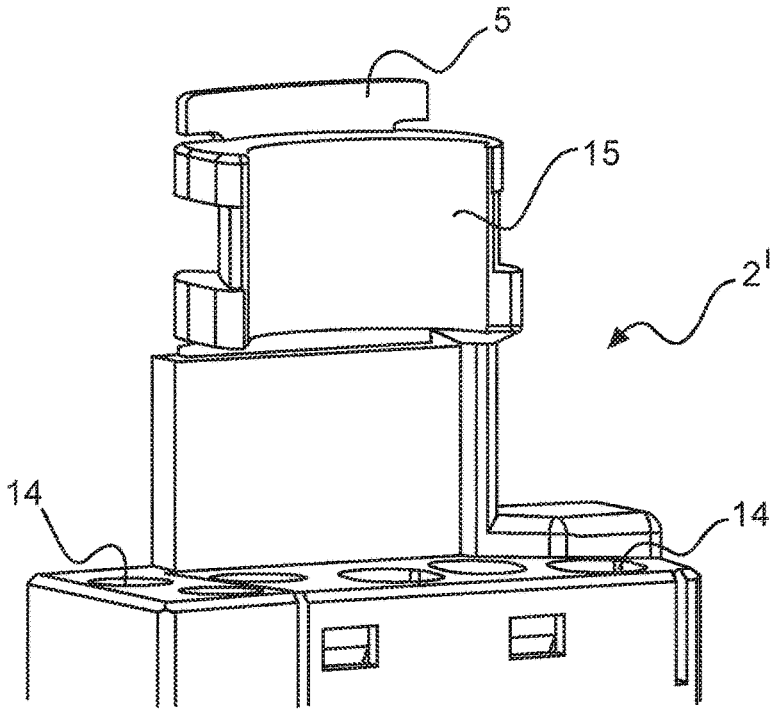
FIG. 4 shows a perspective and sectioned detail of an alternative first plug connector module.
Figure 5:
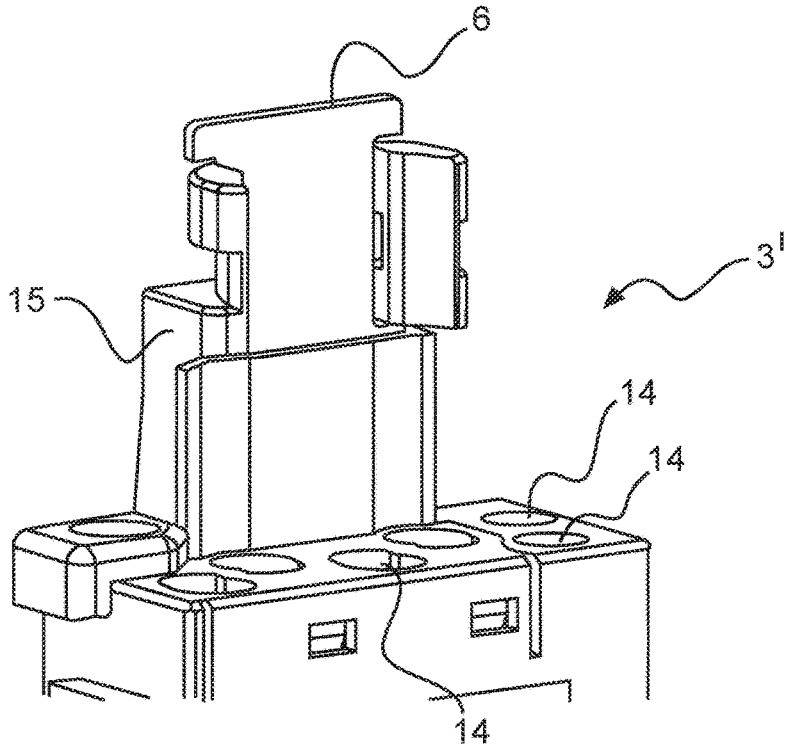
FIG. 5 shows a perspective and sectioned detail of an alternative second plug connector module.

FIGS. 4 and 5 show an alternative variant of the system. Here, the first plug connector module 2' and the second plug connector module 3' each have a metal PE transmission element 15. Otherwise, the plug connector modules 2', 3' are configured analogously to the first embodiment. The PE transmission element 15 is electrically conductively connected to the respective shield transfer element 5, 6. The PE transmission element 15 is electrically conductively connected to a metal holding frame, as already mentioned above, in the installed state. The holding frame (not shown) has a so-called PE contact which, for its part, is electrically conductively connected to a metal housing, likewise already mentioned above, of an industrial plug connection. Continuous potential equalization, which can be advantageous in some applications, including for shielding purposes, can be provided by the PE transmission element 15.

Figure 7:
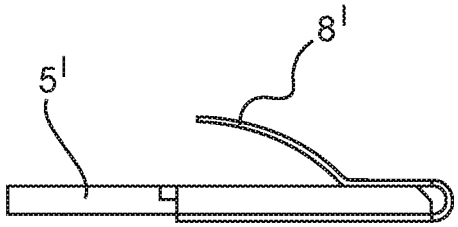
FIG. 7 shows a sectioned side view of a second variant of the shield transfer elements of the plug connector modules.
Figure 8:
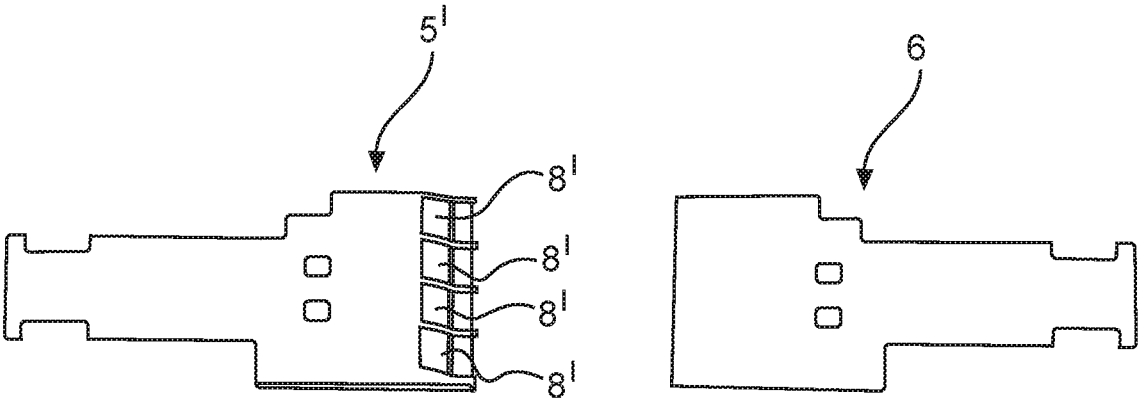
FIG. 8 shows a perspective view of the second variant of the shield transfer elements of the plug connector modules.

FIGS. 7 and 8 show an alternative embodiment of a first shield transfer element 5'. The matching second shield transfer element 6 is designed analogously to the first original embodiment. Here, the lamellae 8' are formed by separate stamped-and-bent components which are manufactured from a material other than that of the main form. Here, the lamellae 8' consist of a copper/beryllium alloy and only have a wall thickness of 0.5 mm to 0.08 millimeters, where the edge regions are incorporated in the wall thickness range. The lamellae 8' can be pushed onto a main body in a simple manner. The lamellae 8' are pushed onto the main body of the first shield transfer element 5' on the plug side.

Figure 9:
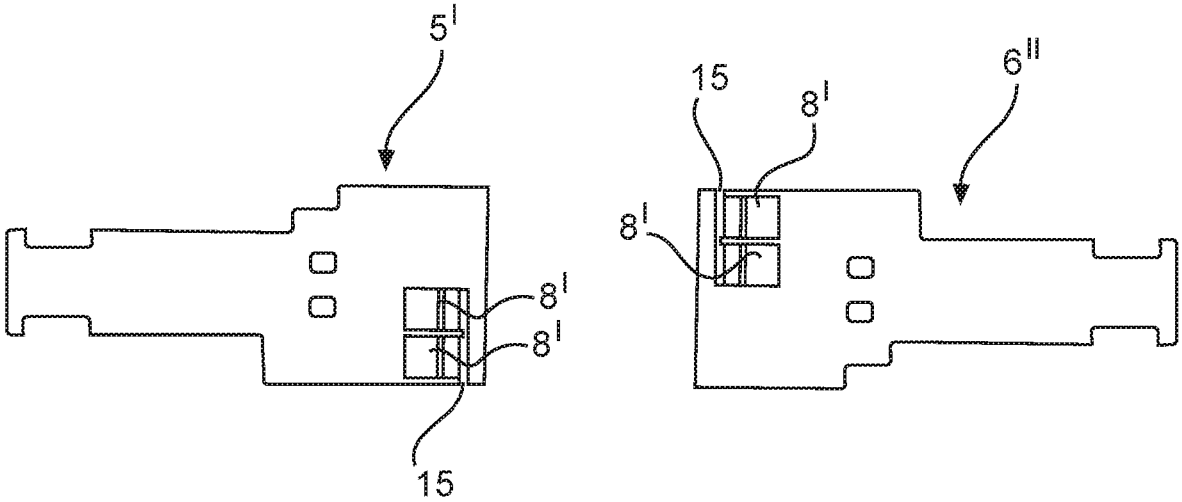
FIG. 9 shows a perspective view of a third variant of the shield transfer elements of the plug connector modules.

FIG. 9 shows a further alternative embodiment of a first shield transfer element 5". A second shield transfer element 6" is configured in a manner matching said first shield transfer element. The two shield transfer elements 5", 6" have a lateral slot 15 into which the separate lamellae 8' can be pushed. In each case two lamellae 8' are pushed into the two shield transfer elements 5", 6" oppositely to one another or laterally offset in relation to one another on the plug side.

Figure 10:
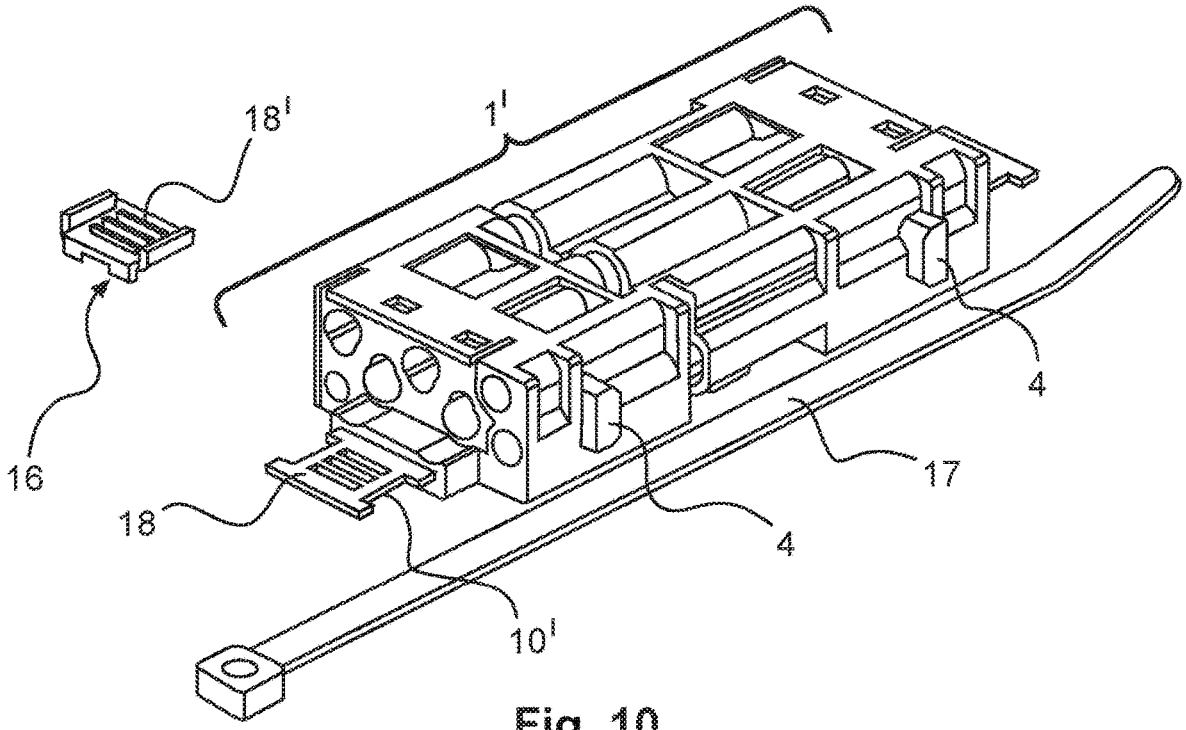
FIG. 10 shows a perspective illustration of an alternative system consisting of a first and a second plug connector module.
Figure 11:
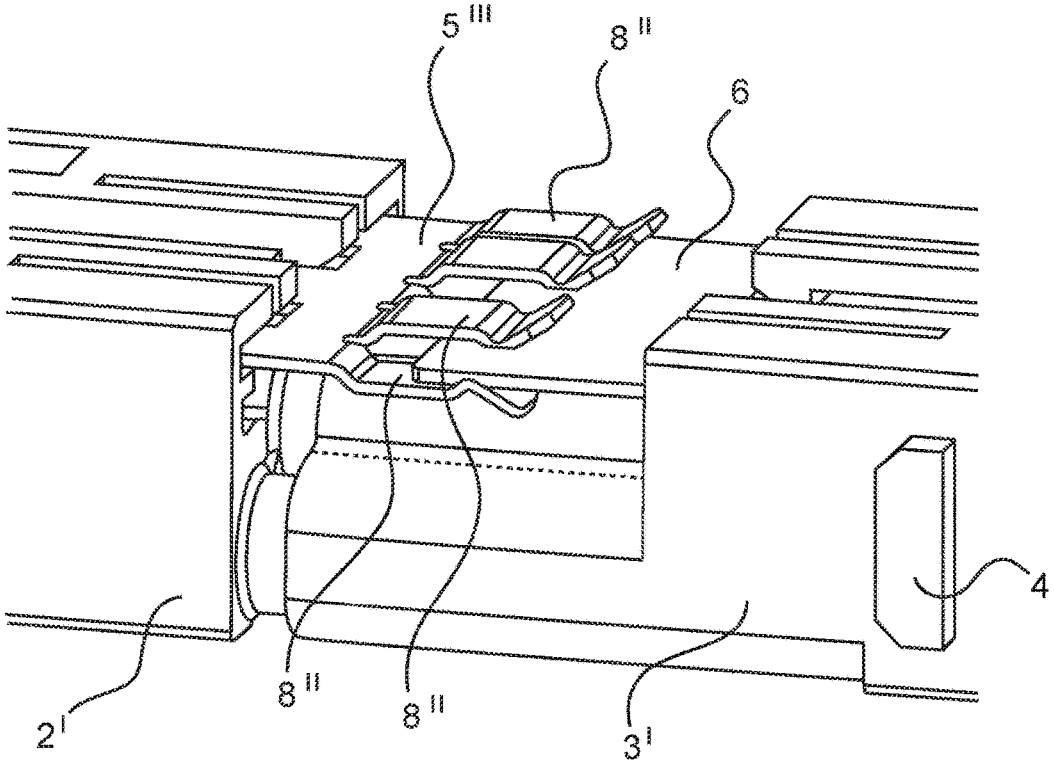
FIG. 11 shows a perspective detail of the alternative system consisting of a first and a second plug connector module.

FIGS. 10 and 11 illustrate an alternative system consisting of a first plug connector module 2' and a second plug connector module 3'. The first plug connector module 2 has a first shield transfer element 5''' from which contact-making fingers 8" project in the axial direction. At least two of these contact making fingers 8" are bent away from the flat main body of the shield transfer element 5''' in opposite directions. This can also be called a fork-like configuration of the contact-making fingers 8". As a result, the contact making fingers 8" can surround and make contact with the second shield transfer element 6 of the second plug connector module 3' on both sides. With this type of contact-connection, no lateral forces occur on the plug connector modules 2', 3', as a result of which the number of possible plugging cycles is increased.

The shield transfer elements 5''', 6 of the alternative system 1' have, on the connection side, protruding flutes 18 which are arranged between the notches 10'. The cable sheath of the connected cable is placed on said flutes. On the other side, the cable is provided with a pressing element 16 and ultimately fixedly pinched between the flutes 18 and the pressing element 16 with the aid of a cable tie 18. Particularly reliable cable strain relief is realized in this way Even though various aspects or features of the invention are shown respectively in combination in the figures, it is clear to a person skilled in the art—unless stated otherwise—that the illustrated and discussed combinations are not the only ones possible. In particular, mutually corresponding units or feature complexes from different exemplary embodiments can be exchanged with one another.

LIST OF REFERENCE SIGNS

1 System
2 First plug connector module
3 Second plug connector module
4 Holder means
5 First shield transfer element
6 Second shield transfer element
7 Slots
8 Contact-making finger
9 Hose clip
10 Notch
11 Contact element
12 Holding plate
13 Finger of the holding plate
14 Recess
15 Slot
16 Pressing element
17 Cable tie
18 Flutes
S Plug side
A Connection side
SR Plugging direction

The invention claimed is:

1. A system, consisting of:

a first plug connector module (2) configured for use in a modular industrial plug connector; and a second plug connector module (3) configured for use in the modular industrial plug connector, wherein the first plug connector module (2) comprises a first shield transfer element (5) having a plug side (S) and a connection side (A), wherein the second plug connector module (3) comprises a second shield transfer element (6) having a plug side (S) and a connection side (A), wherein the first plug connector module (2) is configured to connect a first cable thereto and to secure the first cable on the connection side (A) of the first shield transfer element (5), wherein the second plug connector module (3) is configured to connect a second cable thereto and to secure the second cable on the connection side (A) of the second shield transfer element (6), and wherein the first shield transfer element (5) and the second shield transfer elements (6) can be electrically contact-connected to one another on their respective plug sides.

2. The system as claimed in claim 1, wherein the first shield transfer element (5) is bent in a wave-shaped manner on the plug side (S).

3. The system as claimed in claim 1, wherein the first shield transfer element has, on the plug side (S), at least one slot (7) which runs parallel to a plugging direction (SR).

4. The system as claimed in claim 3, wherein the first shield transfer element has, on the plug side (S), three slots (7) which run parallel to the plugging direction (SR).

5. The system as claimed in claim 1, wherein the first shield transfer element (5) is bent in a wave-shaped manner on the plug side (S), and wherein the first shield transfer element has, on the plug side (S), at least one slot (7) which runs parallel to the plugging direction (SR), and wherein the at least one slot (7) runs in a region of the wave-shaped bend.

6. The system as claimed in claim 1, wherein the second shield transfer element (6) is of continuously flat design.

7. The system as claimed in claim 1, wherein the first and the second shield transfer element (5, 6) have, on the connection side (A), two opposite notches (10) and as a result are of T-shaped configuration.

8. The system as claimed in claim 1, wherein a width of the first shield transfer element (5) is smaller on the connection side (A) than on the plug side (S), and wherein a width of the second shield transfer element (6) is smaller on the connection side (A) than on the plug side (S).

9. The system as claimed in claim 1, wherein the first and the second shield transfer element (5, 6) have a cable fixing element on the connection side (A).

10. The system as claimed in claim 9, wherein the cable fixing element is designed as a hose clip (9).

11. The system as claimed in claim 1, wherein the first and the second shield transfer element (5, 6) each cover a side surface of the plug connector module (2, 3) at least in regions.

12. The system as claimed in claim 11, wherein the first and the second shield transfer element (5, 6) cover at least 75% of the respective side surface of the plug connector module (2, 3).

13. The system as claimed in claim 11, wherein the first and the second shield transfer element (5, 6) cover at least 90% of the respective side surface of the plug connector module (2, 3).

14. The system as claimed in claim 1, wherein the first and the second plug connector module (2, 3) each have at least three contact elements (11, 11') by way of each of which a current with a current intensity of at least 16 Amperes can be transmitted.

15. The system as claimed in claim 14, wherein the first and the second plug connector module (2, 3) each have a holding plate (12) by way of which the contact elements (11, 11') can be secured in the plug connector module (2, 3).

* * * * *